US012798048B2

(12) United States Patent
Chen et al.

(10) Patent No.: US 12,798,048 B2
(45) Date of Patent: Nov. 17, 2026

(54) POLYCRYSTALLINE DIAMOND COMPOSITE WITH A TOUGHENING AGENT AND THE METHODS OF MAKING THE SAME

(71) Applicants: CNPC USA CORP., Houston, TX (US); BEIJING HUAMEI INC., Beijing (CN); CHINA NATIONAL PETROLEUM CORPORATION, Beijing (CN)

(72) Inventors: Jie Chen, Katy, TX (US); Kai Zhang, Katy, TX (US); Chris Cheng, Houston, TX (US); Zhi Zhang, Korla City (CN); Qing Liu, Beijing (CN); Han Liu, Beijing (CN)

(73) Assignees: CNPC USA CORPORATION, Houston, TX (US); BEIJING HUAMEI, INC., Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 379 days.

(21) Appl. No.: 18/437,554

(22) Filed: Feb. 9, 2024

(65) Prior Publication Data

US 2025/0256376 A1 Aug. 14, 2025

(51) Int. Cl.
*B24D 3/06* (2006.01)
*B24D 18/00* (2006.01)

(52) U.S. Cl.
CPC ..... *B24D 3/06* (2013.01); *B24D 18/0009* (2013.01)

(58) Field of Classification Search
CPC ..... B24D 3/06; B24D 18/0009
See application file for complete search history.

(56) References Cited

U.S. PATENT DOCUMENTS

| | | | | |
|---|---|---|---|---|
| 11,400,564 | B1 * | 8/2022 | Chapman | C23C 16/06 |
| 11,839,917 | B2 * | 12/2023 | Mukhopadhyay | E21B 10/567 |
| 2006/0086540 | A1 * | 4/2006 | Griffin | E21B 10/567 175/428 |
| 2008/0073126 | A1 | 3/2008 | Shen et al. | |
| 2009/0173015 | A1 | 7/2009 | Kehavan et al. | |

(Continued)

FOREIGN PATENT DOCUMENTS

IE 58714 B1 * 11/1993 ..... C04B 35/52

OTHER PUBLICATIONS

International Search Report and Written Opinion for PCT patent application: PCT/US2024/17078, Mailed on Aug. 2, 2024.

*Primary Examiner* — Sally A Merkling
(74) *Attorney, Agent, or Firm* — Frank Gao, Esq.

(57) ABSTRACT

A superabrasive compact and a method of making the superabrasive compact are disclosed. A superabrasive compact may comprise a diamond body. The diamond body comprises a first volume of diamond having a plurality of toughening agents dispersed in the diamond matrix constituted with diamond grains. The toughening agents have sizes ranging from about 100 nanometers to about 500 micrometers. The toughening agents have volume ratio of in the diamond body ranging from about 0.5% to about 40%. The toughening agents are at least one of tungsten, tantalum, molybdenum, niobium, iron, chromium, zirconium, titanium, platinum, iridium, hafnium, osmium, ruthenium, rhodium, vanadium, alloys, carbides/nitrides, metal oxides or ceramics containing thereof.

10 Claims, 9 Drawing Sheets

(56) References Cited

U.S. PATENT DOCUMENTS

| | | | | |
|---|---|---|---|---|
| 2011/0061942 | A1* | 3/2011 | DiGiovanni | C01C 3/06<br>175/428 |
| 2013/0067827 | A1 | 3/2013 | Smith | |
| 2023/0287251 | A1* | 9/2023 | Zhang | B24D 18/0009 |

* cited by examiner

POLYCRYSTALLINE DIAMOND COMPOSITE WITH A TOUGHENING AGENT AND THE METHODS OF MAKING THE SAME

TECHNICAL FIELD AND INDUSTRIAL APPLICABILITY

The present invention relates generally to superabrasive materials and a method of making superabrasive compact, and more particularly, to polycrystalline diamond (PCD) consisting of toughening agents to manufacture a polycrystalline diamond compact (PDC) cutter (or "cutting element") for drill bits.

BACKGROUND OF THE INVENTION

Polycrystalline diamond materials and PDC cutters formed therefrom are well known in the art. Conventionally, polycrystalline diamond is usually formed by combining diamond grains with a suitable binder/catalyst material under a high-pressure high-temperature (HPHT) condition. The mixture is subjected to conditions of extremely high temperature/high pressure, where the binder/catalyst material promotes desired intercrystalline diamond-to-diamond bonding between the grains, thereby forming a polycrystalline diamond structure. The resulting polycrystalline diamond structure produces enhanced properties of wear resistance and hardness, making polycrystalline diamond materials extremely useful in aggressive wear and cutting applications where high levels of wear resistance and hardness are desired. Binder/catalyst materials that are typically used for forming polycrystalline diamond include Group VIII elements, cobalt (Co) being the most common. Conventional polycrystalline diamond can comprise from 85 to 95% by volume diamond and a remaining amount of the binder/catalyst material. The binder/catalyst material is present in the polycrystalline diamond material within interstices that exist between the bonded together diamond grains.

PDC cutters typically have a polycrystalline diamond table (or "diamond table" for short) supported by a cermet (e.g., cemented tungsten carbide-cobalt, or WC-Co) substrate and have long been used in earth-boring tools, especially in the oil & gas drilling fields.

The cermet substrate materials have a much larger coefficient of thermal expansion (CTE) than that of the polycrystalline diamond table. Due to the large difference in CTE and large change in temperature during the HPHT process, a high residual thermal stress may be generated in the PDC cutter even with procedures trying to alleviate it. Post-processes after HPHT and following field applications also cause a temperature change that would pose additional thermal stress to the PDC cutter. The residue stress in PDC cutters will be superimposed with externally applied loads and when the overall stress level near the cutting face reaches a certain threshold the PDC will spall and/or chip, causing an accelerated wear. The situation gets worse when drilling in non-uniform formations and/or in the case of bit whirl where severe impact load occurs, and spall, chipping and sometimes, gross fracture are the main failure modes of PDC cutters.

The intrinsic brittleness of the polycrystalline diamond material plus the residue stress makes PDC cutters vulnerable to impact loads. Approaches such as reducing the residue stress by proper diamond table/cermet substrate interfacial surface design and reducing the peak impact force by making a non-planar cutter surface have shown some success in improving the impact toughness, yet it is far from satisfied due to the brittleness of the polycrystalline diamond. It is, therefore, desired that a polycrystalline diamond material be developed that has higher toughness when compared to conventional polycrystalline diamond, so that PDC cutters being made of it have higher impact resistance.

SUMMARY

In one embodiment, a superabrasive compact may comprise a binder/catalyst containing diamond table and a cermet substrate being bonded directly. The diamond table may comprise a plurality of toughening agents dispersed in the intercrystalline bonded diamond matrix. The toughening agents may have sizes ranging from about 100 nanometers to about 500 micrometers, wherein the toughening agents have volume ratio of in the diamond body ranging from about 0.5% to about 40%.

Optionally in any embodiment, the toughening agents may be one of tungsten, tantalum, molybdenum, niobium, iron, chromium, zirconium, titanium, platinum, iridium, hafnium, osmium, ruthenium, rhodium, vanadium, or alloys, carbides, nitrides, metal oxides or ceramics containing thereof.

Optionally in any embodiment, the toughening agents may have at least one coating barrier layer.

Optionally in any embodiment, the coating barrier layer is at least one of carbide layer, nitride layer, diamond nanoparticles, or oxide layer.

Optionally in any embodiment, the diamond table may have a first volume of the diamonds and a second volume of the diamonds, wherein the first volume of the diamonds has the toughening agents dispersed in the intercrystalline bonded diamond matrix, wherein a second volume of the diamonds has no toughening agents.

Optionally in any embodiment, the first volume of the diamonds and the second volume of the diamonds form multilayers with boundaries.

Optionally in any embodiment, the first volume of the diamonds and the second volume of the diamonds form a concentric ring.

Optionally in any embodiment, the first volume of the diamonds and the second volume of the diamonds form slices with boundaries.

Optionally in any embodiment, the cermet substrate is cemented WC-Co.

In another embodiment, a superabrasive compact may comprise a binder/catalyst-free diamond body only. The diamond body may comprise a volume of diamonds having a plurality of toughening agents dispersed in the intercrystalline bonded diamond matrix. The toughening agents may have sizes ranging from about 100 nanometers to about 500 micrometers. The toughening agents may have volume ratio in the diamond body ranging from about 0.5% to about 40%. The toughening agents may be one of tungsten, tantalum, molybdenum, niobium, iron, chromium, zirconium, titanium, platinum, iridium, hafnium, osmium, ruthenium, rhodium, vanadium, alloys, carbides, nitrides, metal oxides or ceramics containing thereof.

Optionally in any embodiment, the toughening agents may have at least one coating barrier layer.

Optionally in any embodiment, the coating barrier layer is at least one of carbide layer, nitride layer, diamond nanoparticles, or oxide layer.

Optionally in any embodiment, the diamond body may have a first volume of the diamonds and a second volume of the diamonds, wherein the first volume of the diamonds has the toughening agents dispersed in the intercrystalline bonded diamond matrix, wherein a second volume of the diamonds has no toughening agents.

Optionally in any embodiment, the first volume of the diamonds and the second volume of the diamonds form multilayers with boundaries.

Optionally in any embodiment, the first volume of the diamonds and the second volume of the diamonds form a concentric ring.

Optionally in any embodiment, the first volume of the diamonds and the second volume of the diamonds form slices with boundaries.

Optionally in any embodiment, the superabrasive compact may be further attached to a cermet substrate to form a conventional PDC cutter.

In yet another embodiment, a method of manufacturing a superabrasive compact may comprise steps of pre-processing diamond powder and toughening agents separately; mixing diamond powder and toughening agents to form a diamond composite blend; assembling the diamond composite blend in a metal can; and sintering the diamond composite blend under high pressure and high temperature.

Optionally in any embodiment, the method may comprise the step of coating the toughening agents with a coating barrier layer.

Optionally in any embodiment, the coating barrier layer is at least one of carbide layer, nitride layer, diamond nanoparticles, or oxide layer. Optionally in any embodiment, the diamond composite blend further comprises a first volume of diamond containing toughening agents and a second volume of diamond without toughening agents.

Optionally in any embodiment, the first volume of the diamonds and the second volume of the diamonds form multilayers with boundaries.

Optionally in any embodiment, the first volume of the diamonds and the second volume of the diamonds form a concentric ring.

Optionally in any embodiment, the first volume of the diamonds and the second volume of the diamonds form slices with boundaries.

Optionally in any embodiment, the assembling may comprise the step of disposing the diamond composite blend on a cermet substrate and together sealed in a metal can, and a superabrasive compact containing binder/catalyst and a substrate is fabricated under normal HPHT.

Optionally in any embodiment, the assembling only consists of diamond composite sealed in a metal can, and a binder/catalyst-free superabrasive compact without a substrate is fabricated under ultra-high pressure and ultra-high temperature.

Optionally in any embodiment, the binder/catalyst-free superabrasive compact without a cermet substrate may be further attached to a cermet substrate to form a conventional PDC cutter structure.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
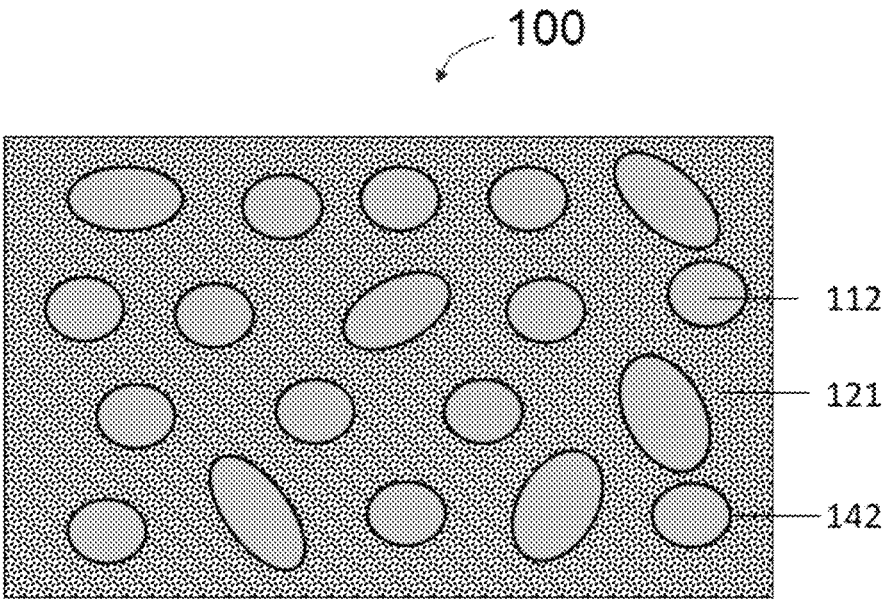
FIG. 1 shows cross-sectional schematic illustration of a polycrystalline diamond (PCD) composite that includes a toughening agent.

Before the description of the embodiment, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50% means in the range of 45%-55%.

The term "superabrasive", as used herein, refers to an abrasive possessing superior hardness and abrasion resistance. Diamond and cubic boron nitride are examples of superabrasives and have Knoop indentation hardness values of over 3500.

As used herein, the term "superabrasive particles" may refer to ultra-hard particles or superabrasive particles having a Knoop hardness of 3500 KHN or greater. The superabrasive particles may include diamond and cubic boron nitride, for example. The term "abrasive", as used herein, refers to any material used to wear away softer materials.

The term "particle" or "particles", as used herein, refers to a discrete body or bodies. A particle is also considered a crystal or a grain.

The term "superabrasive compact", as used herein, refers to a sintered product made using super abrasive particles, such as diamond feed or cubic boron nitride particles. The compact may include a support, such as a cermet support, or may not include a support. The "superabrasive compact" is a broad term, which may include cutting element, cutters, or polycrystalline cubic boron nitride insert.

The term "polycrystalline diamond" or "PCD", as used herein, refers to a plurality of randomly oriented or highly oriented monocrystalline diamond particles, which may represent a body or a particle consisting of a large number of smaller monocrystalline diamond particles of any sizes. Polycrystalline diamond particles usually do not have cleavage planes. In one particular case, a polycrystalline diamond comprises crystalline diamond grains, bound to each other by strong diamond-to-diamond bonds and form a rigid polycrystalline diamond body, and the inter-grain regions, disposed between the bounded grains and filled in one part with a binder/catalyst material (so called "binder/catalyst-containing"), which was used to promote diamond bonding during fabrication, and other part may be filled with other materials which may remain after the sintering of diamond table. Suitable metal solvent catalysts may include the iron group transitional metal in Group VIII of the Periodic table. In another case, a polycrystalline diamond comprises only crystalline diamond grains, bound to each other by strong diamond-to-diamond bonds and form a rigid polycrystalline diamond body, without any catalyst or binder material between diamond grains, so called "binder/catalyst-free".

The terms "diamond particle" or "particles" or "diamond powder", which is a plurality of a large number of single crystal or polycrystalline diamond particles, are used synonymously in the instant application and have the same meaning as "particle" defined above.

The term "polycrystalline diamond compact" or "PDC", refers to the cutter or cutting element of a PDC drill bit, and it typically consists of a polycrystalline diamond table and a cermet substrate bonded together.

PCD materials of this invention are specially engineered to provide higher toughness, and more impact resistance when compared to conventional PCD materials and PDC cutters formed therefrom are, therefore, referred to as impact resistance enhancement PDC cutters.

This current invention discloses embodiments of a PDC structure with a diamond table that includes a material with higher fracture toughness called a toughening agent in the PCD matrix, forming a PCD composite or diamond composite. This new PDC structure containing a PCD composite has the potential to absorb more energy during crack propagation and improve its overall impact resistance.

FIG. 1 illustrates a PCD composite 100 of this invention having a diamond body with a material microstructure comprising at least two material phases. A first phase comprises an intercrystalline diamond-to-diamond bonded matrix 121 extending throughout the diamond body, and a second phase comprises a toughening agent 112 dispersed within the intercrystalline bonded diamond matrix. The diamond-to-diamond bonded matrix 121 is a network of diamond grains bonded together using a HPHT process. The diamond grain size of the PCD matrix ranges from submicrometer, such as about 100 nanometers to about 100 micrometers and may have a single- or multi-modal distribution. The diamond-to-diamond bonded matrix 121 may be binder/catalyst-free or may contain a plurality of binder/catalyst pools dispersed in the interstitials of the diamond grains with an overall catalyst content of less than 15 wt %, and the binder/catalyst may be partially leached out.

The toughening agent 112 is a material with higher fracture toughness than the PCD matrix. The toughening agent 112 may be dispersed uniformly therein. Examples of the toughening agent material may include tungsten, tantalum, molybdenum, niobium, iron, chromium, zirconium, titanium, platinum, iridium, hafnium, osmium, ruthenium, rhodium, vanadium, alloys, carbides, nitrides, metal oxides or ceramics containing thereof, for example. The melting point of the toughening agent 112 is preferably higher than the HPHT process temperature. The shape of the toughening agent may be particulate, rod-like or fiber-like. The toughening may have a single- or multi-modal distribution. The volume ratio of the toughening agent in the diamond composite or diamond body may range from about 0.5% to about 30% depending on specific applications.

In one embodiment, at interface 142 between the toughening agent 112 and the PCD diamond-to-diamond bonded matrix 121, one or more byproducts may form due to chemical reactions. If a binder/catalyst is used when fabricating the PCD composite, element from the toughening agent may dissolve in the binder/catalyst melt during HPHT and show up in the binder/catalyst pools nearby. However, these interface reactions and dissolution of the toughening agent should not have any impact on its original purpose to improve the toughness of the compact and should not prevent the formation of diamond-to-diamond bonding between diamond particles. If leaching is required to remove the catalyst/binder, the toughening agent should be selected or protected properly to survive the leaching process.

The toughening agent 112 may be natively or intentionally coated with one or more barrier layers to prevent or alleviate unwanted reactions or dissolution, or to resist the solution. Exemplary barrier layers may include metal carbide such as silicon carbide, boron carbide, titanium carbide, tungsten carbide, niobium carbide, tantalum carbide, zirconium carbide, hafnium carbide, vanadium carbide, molybdenum carbide, metal nitride such as silicon nitride, boron nitride, titanium nitride, zirconium nitride, aluminum nitride, gallium nitride, tungsten nitride, chromium nitride, vanadium nitride, tantalum nitride, niobium nitride, molybdenum nitride, scandium nitride and alloys of them, and metal oxide such as aluminum oxide, magnesium oxide, iron oxide, chromium oxide, nickel oxide, manganese oxide, yttrium oxide, cerium oxide, zirconium oxide, titanium oxide, silicon oxide, scandium oxide, niobium oxide, tungsten oxide, molybdenum oxide, beryllium oxide and possible mixtures thereof.

Figure 2A:
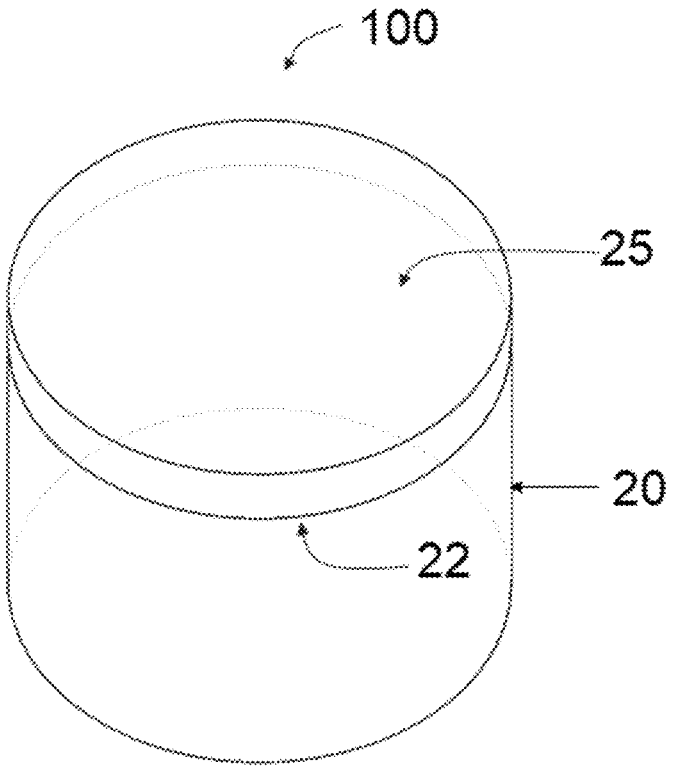
FIG. 2*a* shows an isometric illustration of embodiment of a PDC cutter consisting of a PCD composite according to one exemplary embodiment.

A superabrasive compact 100 in accordance with an embodiment is shown in FIG. 2*a*. Superabrasive compact 100 may be inserted into a downhole of a suitable tool, such as a drill bit, for example. One example of the superabrasive compact 100 may include a diamond body 25 formed by a plurality of polycrystalline diamond particles and a plurality of toughening agents.

In one embodiment, the superabrasive compact 100 may be a standalone compact without a substrate. In another embodiment, the superabrasive compact 100 may include a cermet substrate 20 attached to the diamond body 25. The diamond body 25 and the substrate 20 may be bonded at the interface 22 by an HPHT process or brazing, and the interface 22 may be planar or non-planar/patterned/uneven interface. Although one type of superabrasive compact 100 has been described, other types of superabrasive compacts 100 may be utilized. For example, in one embodiment, superabrasive compact 100 may have a chamfer (not shown) around an outer peripheral of the top surface 21. The chamfer may have a vertical height of about 0.4 mm, and an angle of about 45° degrees, for example.

The cermet substrate 20 may be a cemented metal carbide, attached to the superabrasive diamond body 25 via an interface 22 separating the superabrasive diamond table 25 and the cermet substrate 20. Substrates useful for forming PCD compacts of this invention can be selected from the same general types of conventional materials used to form substrates for conventional PCD materials, including carbides, nitrides, carbonitrides, cermet materials, and mixtures thereof.

Cermet substrate 20 may be made from hard metal carbides and a metallic binder having carbon at least partially dissolved therein. In one embodiment, the metallic substrate 20 may be cemented tungsten carbide-cobalt (WC-Co), while the superabrasive diamond body 25 may be formed from a polycrystalline super-hard material, such as polycrystalline diamond or diamond crystals bonded by itself or by a foreign material.

Figure 2B:
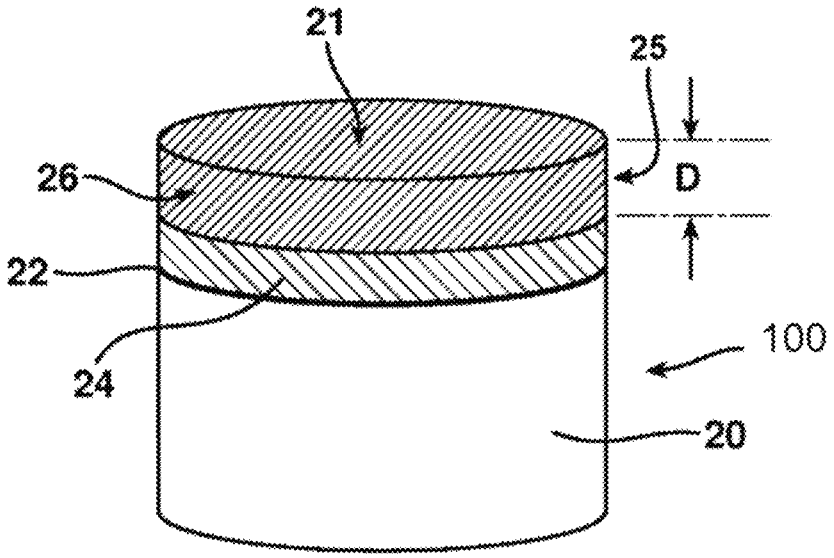
FIG. 2*b* shows an isometric illustration of embodiment of a PDC cutter consisting of a PCD composite according to another exemplary embodiment.

As shown in FIG. 2*b*, the superabrasive diamond body 25 having a top surface 21 may include at least two layers with a first layer 26 and a second layer 24. The second layer 24 may be closer to the interface 22 and may be sandwiched between the cermet substrate 20 and the first layer 26. The minimum number of layers in the multilayer structure is 2, and the minimum thickness of each layer may be as small as 50 μm (D value). Each layer may have a different thickness.

In one embodiment, the first layer 26 may comprise a first volume of diamonds having toughening particles. The second layer 24 may comprise a second volume of diamonds having no toughening particles. The first layer 26 may be positioned along a wear surface or the top surface 21 of the superabrasive compact 100.

Alternatively, in another embodiment, the first layer 26 may comprise a second volume of diamonds without toughening particles. The second layer 24 may comprise a first volume of diamonds having toughening particles.

In one embodiment, the first layer 26 of the diamond body extends to a depth (D) of at least about 0.1 mm, for example, from the wear surface. In another embodiment, the first layer 26 of the diamond body extends to a depth (D) of between about 0.2 mm and about 0.3 mm, for example, from the wear surface.

In one embodiment, the first layer of the diamond body has an average thickness greater than about 0.15 mm.

Figure 2C:
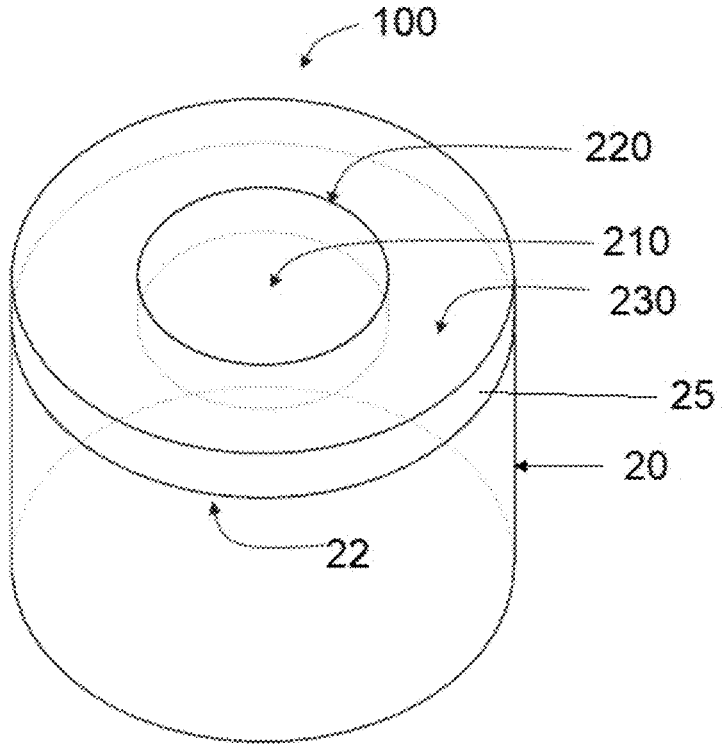
FIG. 2*c* shows an isometric illustration of embodiment of a PDC cutter consisting of a PCD composite according to yet another exemplary embodiment.

As shown in FIG. 2*c*, the first volume of the diamonds 210 and the second volume of the diamonds 230 form a concentric ring with a boundary line 220. The first volume of diamonds 210 may comprise a plurality of diamonds with toughening particles. The second volume of diamonds 230 may comprise a plurality of diamonds without toughening particles. The radius of the first volume of diamond 210 may be in the range of about 30% to about 90% of the diamond body radius. The first volume of diamonds 210 and second volume of diamonds 230 may be bonded at the interface 220 during an HPHT process. The interface 220 may be planar or non-planar/patterned. This core-shell diamond body 25 and the substrate 20 may be bonded at the interface 22 by an HPHT process or brazing, and the interface 22 may be planar or non-planar/patterned.

Figure 2D:
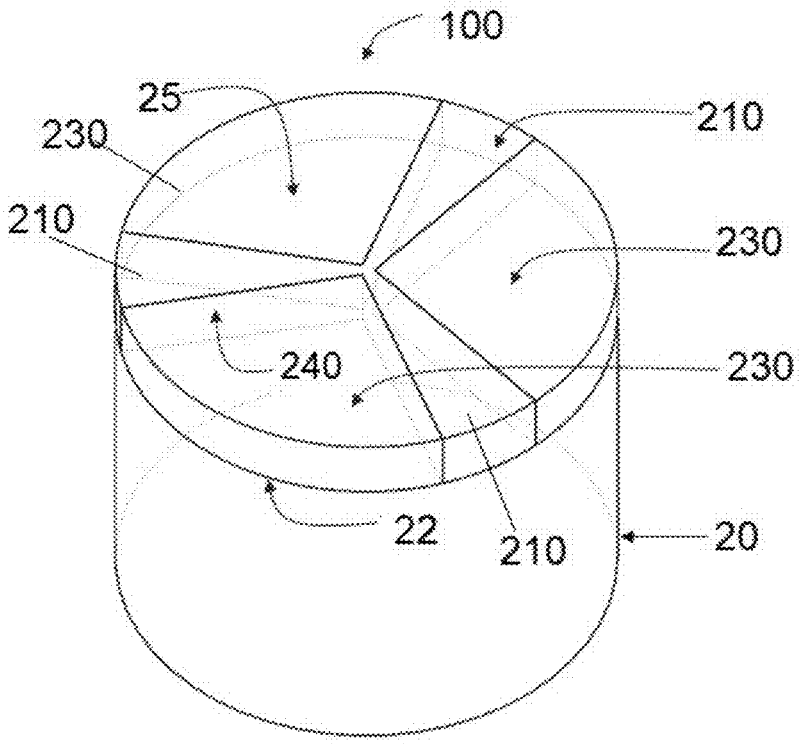
FIG. 2*d* shows an isometric illustration of embodiment of a PDC cutter consisting of a PCD composite according to still another exemplary embodiment.

As shown in FIG. 2*d*, the first volume of the diamonds 210 and the second volume of the diamonds 230 form slices with boundaries 240. The first volume of the diamonds 210 and the second volume of the diamonds 230 are bonded at the boundaries 240 during an HPHT process. The boundaries 240 may be planar or non-planar/patterned. This multi-slice diamond body 25 and the substrate 20 may be bonded at the interface 22 by an HPHT process or brazing, and the interface 22 may be planar or non-planar/patterned. The shape of the polycrystalline diamond compact in the multi-slice diamond table is just for illustration purposes, and it can be any variations that separate the diamond body into multiple slices. Even though the FIG. 2*d* has shown the diamond body with 6 slices, the diamond body could have any more than 2 integer number segments, such as 2, 3, 4, 5, 6, . . . , for example. The first volume of diamonds 210 and second volume of diamonds 230 may have different area of sizes and may be disposed alternately on the diamond body 25.

Figure 3:
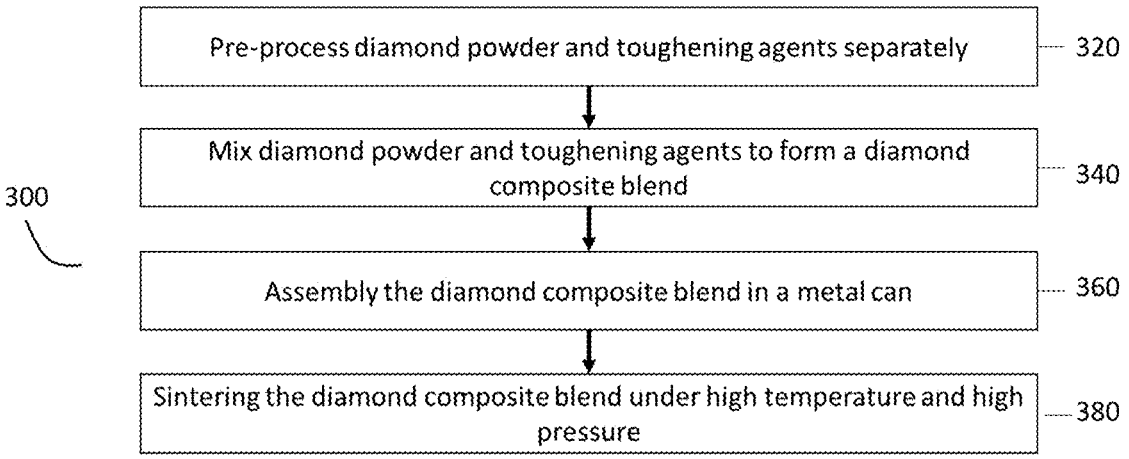
FIG. 3 shows an embodiment of a process manufacturing a superabrasive compact containing a PCD composite.

As shown in FIG. 3, a method 300 of manufacturing a superabrasive compact may comprise steps of pre-processing diamond powder and toughening agents separately at step 320; mixing diamond powder and toughening agents to form a diamond composite blend at step 340; assembling the diamond composite blend in a metal can at step 360; and sintering the diamond composite blend under high temperature and high pressure at step 380.

The method 300 of manufacturing superabrasive compact may further include steps of coating the toughening agents with a coating barrier layer. In one embodiment, the diamond composite blend may comprise a first volume of diamonds and a second volume of diamonds. In some embodiments, the first volume of the diamonds and the second volume of the diamonds may form a concentric ring.

The raw diamond powders are pre-processed, such as size sorting and cleaning, for example, so that they are ready to use at step 320. Then the pre-processed diamond powders are mixed to form a diamond blend with designed size composition, which may have a single- or multi-modal size distribution. Meanwhile, the raw toughening agent material is pre-processed such as size sorting and cleaning so that they are ready to use in step 320. If needed, one or more barrier layers are formed on the surface of the toughening agent. Following that, the diamond blend and toughening agent are mixed, forming a diamond composite blend 340. The toughening agent in the diamond composite blend should be as homogeneous as possible.

In one exemplary embodiment, the coating barrier layer may be coated onto the toughening agent via in-situ chemical reactions, by exposing surface of the toughening agent to a gas or ionized gas containing carbon, nitrogen or oxygen for a specified time, and sometimes at an elevated temperature, so that carbide, nitride or oxide layers forms in-situ on the toughening agent surface.

In another exemplary embodiment, the coating barrier layer may be coated onto the toughening agent via chemical vapor deposition or infiltration, by exposing surface of the toughening agent to precursors of carbide, nitride or oxide for a specified time, and sometimes at an elevated temperature, so that the carbide, nitride or oxide layers deposit therein.

In still another exemplary embodiment, the coating barrier layer may be coated onto the toughening agent via sputter deposition using carbide, nitride or oxide as the target material, where atoms ejected from the target materials and deposited on the surface of the toughening agent.

Figure 4A:
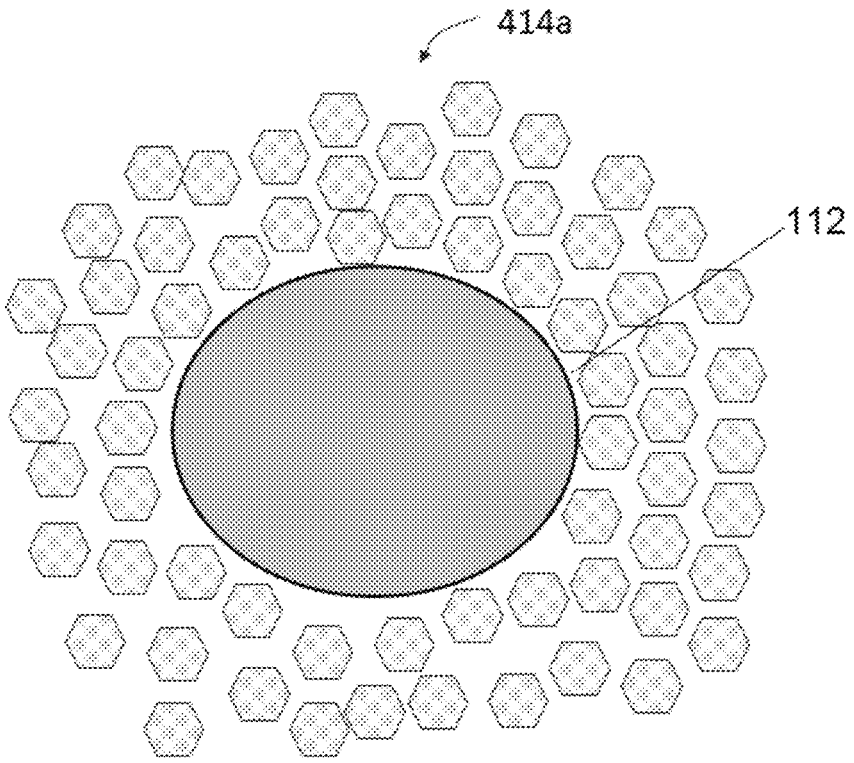
FIG. 4*a* shows a schematic illustration of coating diamond nanoparticles on a toughening agent.
Figure 4B:
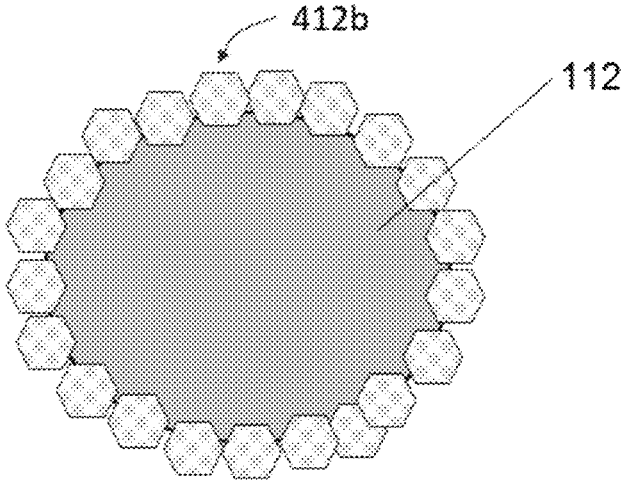
FIG. 4*b* shows a schematic illustration of coating diamond nanoparticles on a toughening agent under pressure.

In yet another exemplary embodiment, the barrier layer may be diamond nanoparticles, and an exemplary embodiment process is imprinting. As illustrated in FIG. 4*a*, the toughening agent 112 and diamond nanoparticles 414*a* are well mixed at first, with the toughening agent surrounded by diamond nanoparticles 414*a*. Then the mixture may be subjected to an isostatic pressure for a specified time so that the hard diamond nanoparticles stick into the surface of the toughening agent 412*b*. An elevated temperature, such as hot isostatic pressure, may be used. Finally, the toughening agent coated with nanoparticles may be separated from the mixture by sieving.

Figure 5A:
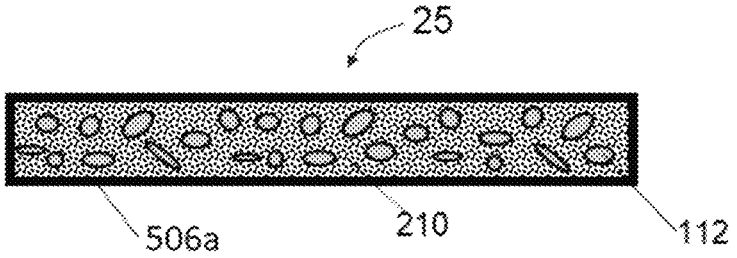
FIG. 5*a* shows an embodiment of assembly to fabricate a binder/catalyst-free PCD composite according to one exemplary embodiment.

FIG. 5*a* illustrates an embodiment of assembly to fabricate a stand-alone binder/catalyst-free polycrystalline diamond composite compact 25. In this assembly, a volume of diamonds 210 having a plurality of diamonds with toughening agents 112 without the presence of a catalyst/binder is encapsulated in a metal can 506*a*. The metal can 506*a* may be made of refractive metals, such as niobium, tantalum, molybdenum, for example, and subjected to an ultra-high pressure (>14.0 GPa) and ultra-high temperature (>1600° C.) process, so that diamond-to-diamond bonding forms between adjacent diamond particles and form a dense compact. Then the assembly undergoes post-processing to obtain a compact. The compact may be bounded to a cermet substrate using an HPHT process or brazing, forming a PDC structure 100 illustrated in FIG. 2*a*.

Figure 5B:
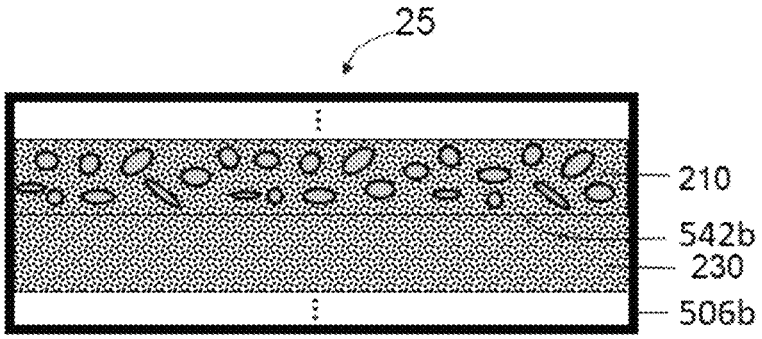
FIG. 5*b* shows an embodiment of assembly to fabricate a binder/catalyst-free PCD composite according to another exemplary embodiment.

FIG. 5*b* illustrates an embodiment of assembly to fabricate a stand-alone catalyst/binder-free multilayer diamond compact 25. In this assembly, a first and second volume of diamonds 210 and 230 are placed adjacently alternately with a boundary 542*b*, and together encapsulated in a metal can 506*b*. The metal can 506*b* may be made of refractive metals such as niobium, tantalum, molybdenum, for example, and subjected to an ultra-high pressure and ultra-high temperature process, so that diamond-to-diamond bonding forms between adjacent diamond particles and form a dense polycrystalline diamond compact 25. The polycrystalline diamond with toughening agents and polycrystalline diamond without toughening agents may be bonded together during this process, forming diamond-to-diamond bonding between adjacent diamond grains in those two regions. There can be many layers of diamond volumes. Then the assembly may undergo post-processing to obtain a multilayer diamond compact. This multilayer diamond compact may be bonded to a cermet substrate using an HPHT process or brazing, forming a PCD compact structure 100 illustrated in FIG. 2*b*.

Figure 5C:
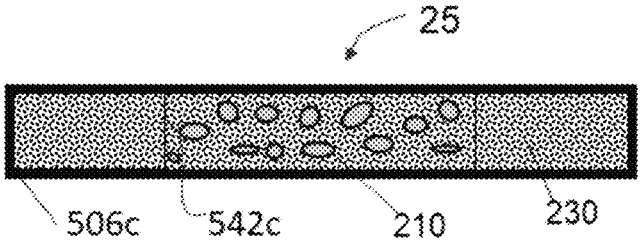
FIG. 5*c* shows an embodiment of assembly to fabricate a binder/catalyst-free PCD composite according to yet another exemplary embodiment.

As shown in FIG. 5*c*, an exemplary embodiment of assembly is configured to fabricate a catalyst/binder-free core-shell diamond body 25. In this assembly, a volume of diamonds 210 having toughening agents and diamonds 230 without toughening agents are placed adjacently with a boundary 542*c*, and together encapsulated in a metal can 506*c*. The metal can 506*c* may be made of refractive metals such as niobium, tantalum, molybdenum, and subjected to an ultra-high pressure and ultra-high temperature process, so that diamond-to-diamond bonding forms between adjacent diamond particles and form a dense polycrystalline diamond compact. The polycrystalline diamonds with toughening agents and polycrystalline diamonds without toughening agents may also be bonded together during this process, forming diamond-to-diamond bonding between adjacent diamond grains in those two regions. The assembly undergoes post-processing to obtain a polycrystalline diamond core-shell diamond compact. This core-shell diamond compact may be bonded to a carbide substrate using an HPHT process or brazing, forming a PDC structure 100 illustrated in FIG. 2*c*.

Figure 5D:
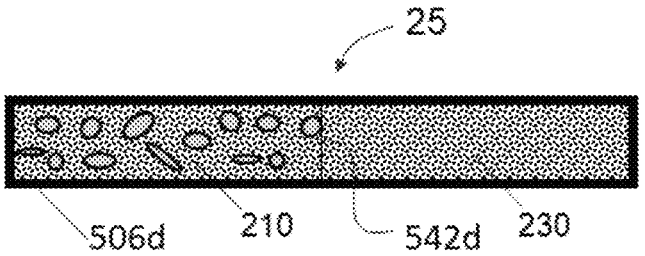
FIG. 5*d* shows an embodiment of assembly to fabricate a binder/catalyst-free PCD composite according to yet another exemplary embodiment.

FIG. 5*d* illustrates an embodiment of assembly to fabricate a binder/catalyst-free multi-slice polycrystalline diamond body 25. In this assembly, a volume of diamonds with toughening agents 210 and diamonds without toughening agents 230 are placed adjacently with a boundary 542*d*, and together encapsulated in a metal can 506*d* made of refractive metals such as niobium, tantalum, molybdenum. The assembly is subjected to an ultra-high pressure and ultra-high temperature process, so that diamond-to-diamond bonding forms between adjacent diamond particles and form a dense compact. The polycrystalline diamonds with and without toughening agents will also be bonded together during this process, forming diamond-to-diamond bonding between adjacent diamond grains in those two regions. Then the assembly undergoes post-processing to obtain a multi-slice polycrystalline diamond compact. This multi-slice diamond compact may be bonded to a carbide substrate using an HPHT process or brazing, forming a PDC structure 100 illustrated in FIG. 2*d*.

Figure 6A:
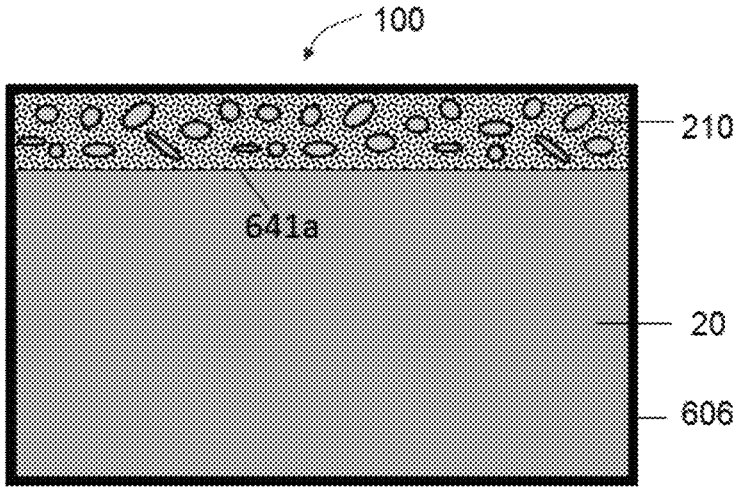
FIG. 6*a* shows an embodiment of assemblies to fabricate a PDC cutter containing a binder/catalyst-containing PCD composite according to one embodiment.

FIG. 6*a* illustrates an exemplary embodiment of assembly to fabricate a polycrystalline diamond compact with a binder/catalyst-containing polycrystalline diamond having toughening agents. In this assembly, a volume of diamonds 210 is disposed on a substrate 20 with a boundary 641*a*, and together encapsulated in a metal can 606 made of refractive metals such as niobium, tantalum, molybdenum, and subjected to an HPHT process, so that diamond-to-diamond bonding forms between diamond particles and forms a dense compact. Meanwhile, the polycrystalline diamond and the substrate are bonded together at interface 641*a* under HPHT process. Then the assembly undergoes post-processing to obtain a polycrystalline diamond compact structure 100 illustrated in FIG. 2*a*.

Figure 6B:
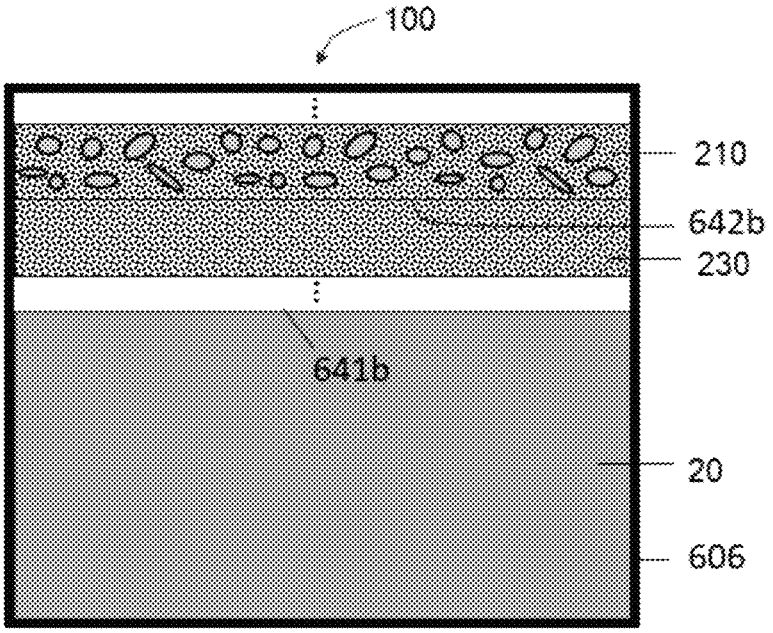
FIG. 6*b* shows an embodiment of assemblies to fabricate a PDC cutter containing a binder/catalyst-containing PCD composite according to another embodiment.

As shown in FIG. 6*b*, an exemplary embodiment of assembly may be configured to fabricate a binder/catalyst-containing polycrystalline diamonds body with a first volume of polycrystalline diamonds with toughening agents and a second volume of polycrystalline diamonds without toughening agents. In this assembly, the first volume and the second volume of diamonds are placed adjacent alternately with a boundary 642*b*, and disposed on a substrate 20 with a boundary 641*b*, and together encapsulated in a metal can 606. The metal can 606 may be made of refractive metals such as niobium, tantalum, molybdenum, and subjected to an HPHT process, so that diamond-to-diamond bonding forms between diamond particles and form a dense compact.

Meanwhile, the polycrystalline diamonds are bonded together by diamond-to-diamond bonding at interface 642*b* and forming a multilayer diamond table. This multilayer diamond table and the substrate are bonded together at interface 641*b*. Then the assembly undergoes post-processing to obtain a polycrystalline diamond structure 100 illustrated in FIG. 2*b*.

Figure 6C:
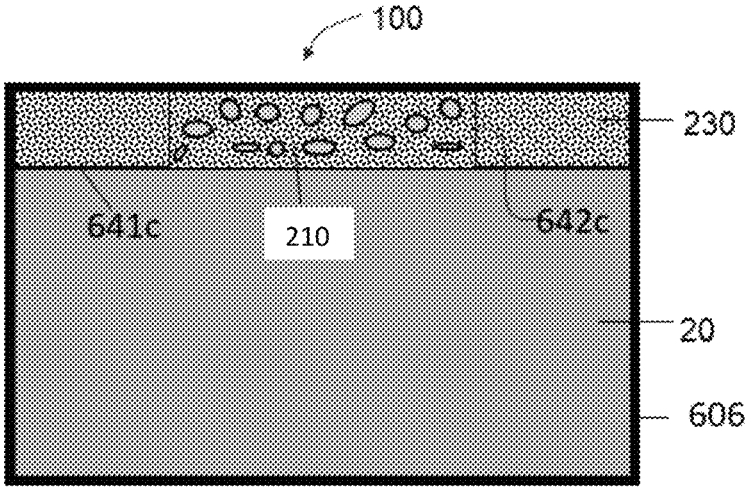
FIG. 6*c* shows an embodiment of assemblies to fabricate a PDC cutter containing a binder/catalyst-containing PCD composite according to yet another embodiment.

FIG. 6*c* illustrates an exemplary embodiment of assembly to fabricate a binder/catalyst-containing polycrystalline diamond compact with a first volume of diamonds with toughening agents as a core and a second volume of diamonds as outer shell for the diamond body. In this assembly, the first volume of diamonds with toughening agents 210 and the second volume of diamonds without toughening agents 230 are placed adjacently with a boundary 642*c*, and are disposed on a substrate 20 with a boundary 641*c*, and together encapsulated in a metal can 606. The metal can 606 is subjected to an HPHT process, so that diamond-to-diamond bonding forms between diamond particles in both polycrystalline diamond with toughening agents and polycrystalline diamond without toughening agents and form a dense compact. Meanwhile, the polycrystalline diamond with toughening agents and polycrystalline diamond without toughening agents are bonded together by diamond-to-diamond bonding at interface 642*c* and forming a core-shell diamond table. This core-shell diamond table and the substrate are bonded together at interface 641*c*. Then the assembly undergoes post-processing to obtain a polycrystalline diamond structure 100 illustrated in FIG. 2*c*.

Figure 6D:
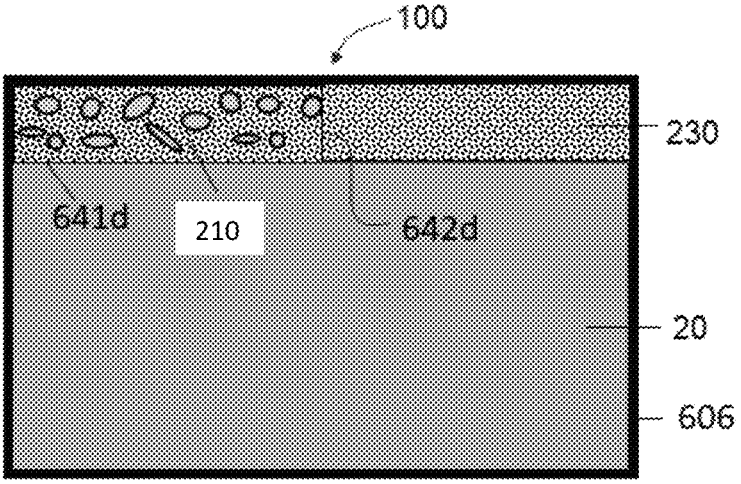
FIG. 6*d* shows an embodiment of assemblies to fabricate a PDC cutter containing a binder/catalyst-containing PCD composite according to still another embodiment.

As shown in FIG. 6*d*, an exemplary embodiment of assembly is configured to fabricate a binder/catalyst-containing polycrystalline diamond compact with a first volume of diamonds having toughening agents and a second volume of diamonds having no toughening agents in multi-slice diamond table. In this assembly, the first volume of diamonds with toughening agents 210 and the second volume of diamonds without toughening agents 230 are placed adjacently with a boundary 642*d*, and disposed on a substrate 20 with a boundary 641*d*, and together encapsulated in a metal can 606, and subjected to an HPHT process. The diamond-to-diamond bonding forms between diamond particles in both diamonds with toughening agents and diamonds without toughening agents. Meanwhile, the diamonds with toughening agents and diamonds without toughening agents are bonded together by diamond-to-diamond bonding at interface 642*d* like slices forming a diamond body. This multi-slice diamond body and the substrate are bonded together at interface 641*d*. Then the assembly undergoes post-processing to obtain a PDC structure 100 illustrated in FIG. 2*d*.

In any embodiment of the assemblies mentioned above, a toughening agent is combined with the diamond grains, and the mixture is blended together by conventional methods such as by ball or attritor milling for as long as necessary to obtain good toughening agent coverage over or with the diamonds. Suitable toughening agent useful for forming impact resistance PCD materials of this invention include those that have higher fracture toughness than polycrystalline diamond-diamond matrix. Suitable toughening agent materials may include those at least one of tungsten, tantalum, molybdenum, niobium, iron, chromium, zirconium, titanium, platinum, iridium, hafnium, osmium, ruthenium, rhodium, vanadium, or alloys containing thereof.

The resulting mixture is cleaned to enhance the sinterability of the powder by treatment at high temperature in a vacuum or reducing atmosphere. The blended powder mixture is loaded into a desired container for placement within a suitable high pressure/high temperature consolidation and sintering device. The device is then activated to subject the container to a desired high pressure/high temperature condition to effect consolidation and sintering. Superabrasive compacts, which some may form impact resistance PCD materials of this invention can be consolidated and sintered by conventional equipment and techniques used to consolidate and sinter conventional PCD materials.

It is to be understood that the type and amount of toughening agent(s) that is used can and will vary depending on the particular type and amount of binder/catalyst material that is used, in addition to the particular application for the resulting PCD compact or element that is formed from the PCD material. Additionally, as noted above, the amount of the toughening agents that are used can and will vary depending on the targeting abrasive and impact resistances of the PCD compact.

In an exemplary embodiment, it is desired that the types and amounts of the toughening agent(s) be carefully selected to enable formation of a PCD material during the consolidation and sintering process that provides a desired level of improvement in toughness while also not adversely affecting the sintered product, e.g., displaying minimal sintering defects such as microcracks. Ideally, the type and amount of the toughening agents used to form PCD materials of this invention will be that which produces an ideal combination of optimal PCD compact physical properties and enables robust manufacturability.

Additionally, it is to be understood that PCD compacts of this invention comprise a PCD body that is either entirely or partially formed from the PCD material of this invention. In the exemplary embodiment illustrated in FIG. 2*a*, the PCD compact comprises a PCD body that is made up entirely of the PCD material of this invention, i.e., comprising the reaction product of the binder/catalyst and toughening agent distributed throughout. Alternatively, FIG. 2*b* illustrates a PCD compact embodiment 100 of this invention where only a portion of the PCD body 100 is formed from the PCD material of this invention. In such embodiment, the PCD body 100 comprises a first layer 26 that comprises the PCD material of this invention, and a second layer 24 positioned adjacent the first layer that does not. The first layer 26 can be positioned adjacent to a working surface of the PCD compact to take advantage of the improved toughness. The first region can comprise any type of conventional PCD material or non-PCD-containing material.

As shown in FIG. 6*a*-6*d*, in yet another embodiment, a pre-sintered tungsten carbide green body 20 may be inserted into the cup 606 instead of cemented tungsten carbide. The loaded cup is further assembled using HPHT cell components and is subjected to a cubic press for HPHT sintering process. The sintered piece is further ground and machined to the final size of the PCD product as illustrated in the FIG. 2.

The above-identified PCD material first embodiment will be better understood with reference to the following example:

Example 1

PDC cutters are produced by the methods described in the prior art, composed of a starting diamond powder with diamond powder of a grain size of from about 10 nm to about 500 microns in diameter, the toughening agents have volume ratio of in the diamond body ranging from about 0.5% to about 30%, and a cemented WC-Co (with 10-15 wt % Co) substrate, attached to the polycrystalline diamond via an interface between the polycrystalline diamond and tungsten carbide.

The tantalum cup is loaded by a volume of diamond feed with toughening agents, followed by inserting a WC-Co substrate (OD 0.711"). The assembled tantalum cup was further encapsulated with salt and graphite sleeves as well as some graphite pills. The tantalum cup is fit inside the sleeves tightly. The encapsulated assembly is transferred into cell loading area, and the entire body is loaded into the cell specifically designed for cubic press. The cell is then loaded into the space formed by the cubic press anvils and is applied a high pressure and high temperature (HPHT) cycle to the cell for 30 minutes. The soak pressure is maintained around 6.0 GPa and the soak temperature was about 1550° C. The soak time for bonding of the diamond disc to the carbide was about 10 minutes. After the bonding cycle, the cup is taken out of the pressed cell for further post processing.

The cutter is ground and finished to 16 mm in diameter, and 13.2 mm in height. A 45 degree bevel is placed on the edge of the diamond, with a thickness of about 0.4 mm.

While reference has been made to specific embodiments, it is apparent that other embodiments and variations can be devised by others skilled in the art without departing from their spirit and scope. The appended claims are intended to be construed to include all such embodiments and equivalent variations.

We claim:

1. A superabrasive compact, comprising:

a diamond body, wherein the diamond body comprises:

a plurality of toughening agents dispersed in an intercrystalline bonded diamond matrix, the toughening agents comprising a material selected to enhance the fracture toughness of the diamond body, wherein the toughening agents have sizes ranging from about 100 nanometers to about 500 micrometers, wherein the toughening agents have a volume ratio in the diamond body ranging from about 0.5% to about 40%; and a metallic substrate in direct contact with the diamond body.

2. The superabrasive compact of claim 1, wherein the toughening agents are at least one of tungsten, tantalum, molybdenum, niobium, iron, chromium, zirconium, titanium, platinum, iridium, hafnium, osmium, ruthenium, rhodium, vanadium, alloys, carbides, nitrides, metal oxides or ceramics containing thereof.

3. The superabrasive compact of claim 1, wherein the toughening agents have at least one coating barrier layer.

4. The superabrasive compact of claim 1, wherein the metallic substrate comprises a metal carbide.

5. The superabrasive compact of claim 4, wherein the metallic carbide comprises tungsten carbide.

6. The superabrasive compact of claim 1, wherein the diamond table has a first volume of the diamonds and a second volume of the diamonds, wherein the first volume of the diamonds has the toughening agents dispersed in the diamond matrix constituted with diamond grains, wherein a second volume of the diamonds has no toughening agents.

7. The superabrasive compact of claim 6, wherein the first volume of the diamonds and the second volume of the diamonds form multilayers with boundaries.

8. The superabrasive compact of claim 6, wherein the first volume of the diamonds and the second volume of the diamonds form a concentric ring.

9. The superabrasive compact of claim 6, wherein the first volume of the diamonds and the second volume of the diamonds form slices with boundaries.

10. The superabrasive compact of claim 3, wherein the coating barrier layer is at least one of carbide layer, nitride layer, alloy, diamond, or oxide.

* * * * *